US007556089B2

(12) United States Patent
Bhatti et al.

(10) Patent No.: US 7,556,089 B2
(45) Date of Patent: Jul. 7, 2009

(54) LIQUID COOLED THERMOSIPHON WITH CONDENSER COIL RUNNING IN AND OUT OF LIQUID REFRIGERANT

(75) Inventors: Mohinder Singh Bhatti, Amherst, NY (US); Ilya Reyzin, Williamsville, NY (US); Shrikant Mukund Joshi, Williamsville, NY (US)

(73) Assignee: Coolit Systems, Inc., Calgary AB (CA)

( * ) Notice: Subject to any disclaimer, the term of this patent is extended or adjusted under 35 U.S.C. 154(b) by 179 days.

(21) Appl. No.: 11/395,697

(22) Filed: Mar. 31, 2006

(65) Prior Publication Data

US 2007/0227702 A1 Oct. 4, 2007

(51) Int. Cl.
*F28D 15/00* (2006.01)
*F28F 7/02* (2006.01)

(52) U.S. Cl. ..... 165/104.33; 165/80.4; 361/700

(58) Field of Classification Search ..... 165/104.21, 165/104.31, 104.33, 104.22, 80.4, 80.5, 108; 62/113, 503, 513; 361/700; 257/715
See application file for complete search history.

(56) References Cited

U.S. PATENT DOCUMENTS

| | | | | |
|---|---|---|---|---|
| 1,890,205 | A * | 12/1932 | Andresen | 62/218 |
| 5,289,871 | A * | 3/1994 | Leidinger | 165/110 |
| 5,529,115 | A | 6/1996 | Paterson | 165/104.33 |
| 6,408,937 | B1 * | 6/2002 | Roy | 165/104.33 |
| 6,588,498 | B1 * | 7/2003 | Reyzin et al. | 165/104.33 |

* cited by examiner

*Primary Examiner*—Teresa J Walberg
(74) *Attorney, Agent, or Firm*—Arent Fox LLP

(57) ABSTRACT

The invention provides a fluid heat exchange assembly comprising a housing containing a liquid refrigerant presenting a surface. A tube is coiled in adjacent coils around an axis parallel to the surface of the liquid refrigerant with a first sector of each coil disposed below the liquid surface and a second sector of each coil disposed above the liquid surface whereby said tube runs into and out of said liquid refrigerant.

1 Claim, 2 Drawing Sheets

LIQUID COOLED THERMOSIPHON WITH CONDENSER COIL RUNNING IN AND OUT OF LIQUID REFRIGERANT

BACKGROUND OF THE INVENTION

1. Field of the Invention

The subject invention relates to a fluid heat exchanger for cooling an electronic device.

2. Description of the Prior Art

The operating speed of computers is constantly being improved to create faster computers. With this, comes increased heat generation and a need to effectively dissipate that heat.

Heat exchangers and heat sink assemblies have been used that apply natural or forced convection cooling methods to dissipate heat from electronic devices that are highly concentrated heat sources such as microprocessors and computer chips. These heat exchangers typically use air to directly remove heat from the electronic devices; however air has a relatively low heat capacity. Thus, liquid-cooled units called LCUs employing a cold plate in conjunction with high heat capacity fluids have been used to remove heat from these types of heat sources. Although LCUs are satisfactory for moderate heat flux, increasing computing speeds have required more effective heat sink assemblies.

Accordingly, thermosiphon cooling units (TCUs) have been used for cooling electronic devices having a high heat flux. A typical TCU absorbs heat generated by the electronic device by vaporizing a working fluid housed on the boiler plate of the unit. The boiling of the working fluid constitutes a phase change from liquid-to-vapor state and as such the working fluid of the TCU is considered to be a two-phase fluid. Vapor generated during boiling of the working fluid is then transferred to a condenser, where it is liquefied by the process of film condensation over the condensing surface of the TCU. The heat is rejected into a stream of air flowing through a tube running through the condenser or flowing over fins extending from the condenser. Alternatively, a second refrigerant can flow through the tube increasing the cooling efficiency. The condensed liquid is returned back to the boiler plate by gravity to continue the boiling-condensing cycle.

An example of a cooling system for electronic devices is disclosed in U.S. Pat. No. 5,529,115 to Paterson.

The Paterson patent discloses an assembly for cooling an electronic device including a housing partially filled with a refrigerant wherein heat generated by the electronic device dissipates into the housing causing the refrigerant to boil. A conduit extends through the housing and air flows through the conduit. The vapors boiled off the refrigerant then rise upwardly and condense on the ceiling of the housing and on the outside surface of the conduit. The conduit extends linearly through the housing and is partially submerged in the refrigerant.

Although the prior art dissipates heat from electronic devices, as computing speeds increase, there is a continuing need for cooling devices having more efficient and/or alternative heat transfer capabilities as compared to the conventional electronic cooling assemblies.

SUMMARY OF THE INVENTION AND ADVANTAGES

The invention provides a fluid heat exchanger assembly including a housing having an inlet and an outlet, a refrigerant disposed in the housing and a tube extending from the inlet to the outlet for establishing a flow of cooling liquid from the inlet to the outlet. The assembly is distinguished by the tube being coiled in adjacent coils disposed on an axis parallel to the surface of the liquid refrigerant with a first sector of each coil disposed below the liquid surface and a second sector of each coil disposed above the liquid surface whereby the tube runs into and out of the liquid refrigerant.

The invention also provides for a method of cooling an electronic device including the step of flowing cooling liquid into and out of the liquid refrigerant in adjacent coils in a helical path in the housing.

By forcing the cooling liquid through the partially immersed coiled tube, the liquid refrigerant is cooled, which enhances the boiling efficiency of the assembly. Since the heat capacity of the cooling liquid is high the heat abstracted from the liquid refrigerant does not greatly affect the condensing efficiency of the assembly in the upper portion of the coiled tube surrounded by vapors boiled off of the liquid refrigerant. Furthermore, by coiling the tube into and out of the refrigerant, the invention increases the surface area of the cooling liquid filled tube contacting the refrigerant, thus increasing the condensing efficiency. Therefore, the invention increases the boiling efficiency while maintaining the condensing efficiency, thereby increasing the cooling efficiency of the assembly.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate corresponding parts throughout the several views, a fluid heat exchanger assembly 20 is generally shown for cooling an electronic device 22.

Figure 1:
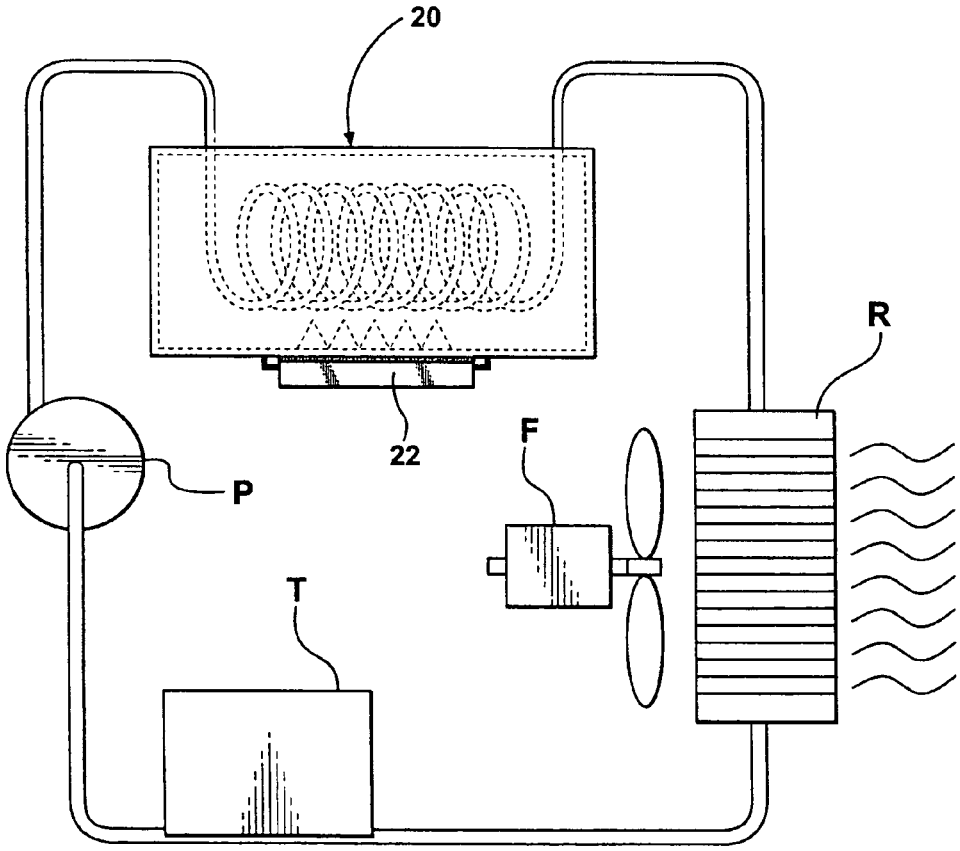
FIG. 1 is a schematic of a liquid cooling system in which the heat exchanger of the subject invention may be utilized.
Figure 2:
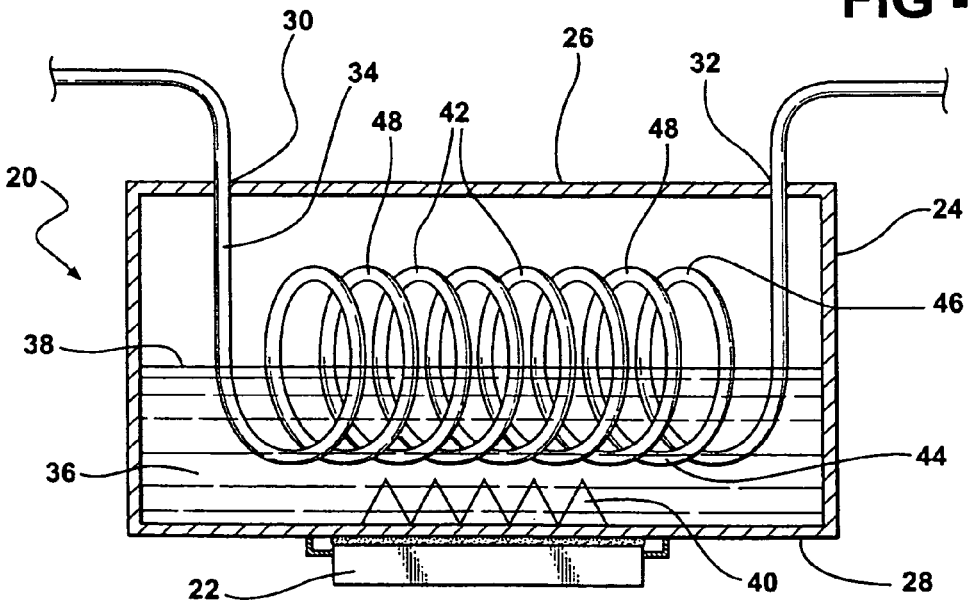
FIG. 2 is a cross-sectional view of the heat exchanger shown in FIG. 1.

The heat exchanger assembly 20 is incorporated into a cooling system as illustrated in FIG. 1. Cooling liquid is moved through the heat exchanger assembly 20 by a fluid mover such as a pump P. The pump P moves the cooling liquid through a heat extractor or radiator R having a fan F to dissipate heat from the cooling liquid. After being cooled by the radiator R, the cooling liquid is stored in a holding tank T until it is recycled through the heat exchanger assembly 20.

The assembly 20 includes a housing 24 having an upper portion 26 and a lower portion 28 and is used to cool the electronic device 22 engaging or secured to the lower portion 28 of the housing 24. An inlet 30 and an outlet 32 are disposed in the upper portion 26 of the housing 24 and a tube 34 having a uniform cross-section extends between the inlet 30 and the outlet 32 for establishing a flow of cooling liquid from the inlet 30 to the outlet 32 within the housing 24.

A liquid refrigerant 36 is disposed in the lower portion 28 of the housing 24 and presents a surface 38 for liquid-to-vapor transformation, i.e., boiling. The housing 24 is hermetically sealed about the tube 34 to contain the refrigerant 36. The tube 34 may comprise a thin gage metal, although various materials may be utilized that are inert to or non-active with the cooling liquid and the refrigerant 36.

A plurality of heat transfer fins 40 extend from the bottom of the lower portion 28 of the housing 24 for increasing heat transfer from an electronic device 22 disposed on the exterior of the lower portion 28 of the housing 24 to the interior of the lower portion 28 of the housing 24.

Figure 3:
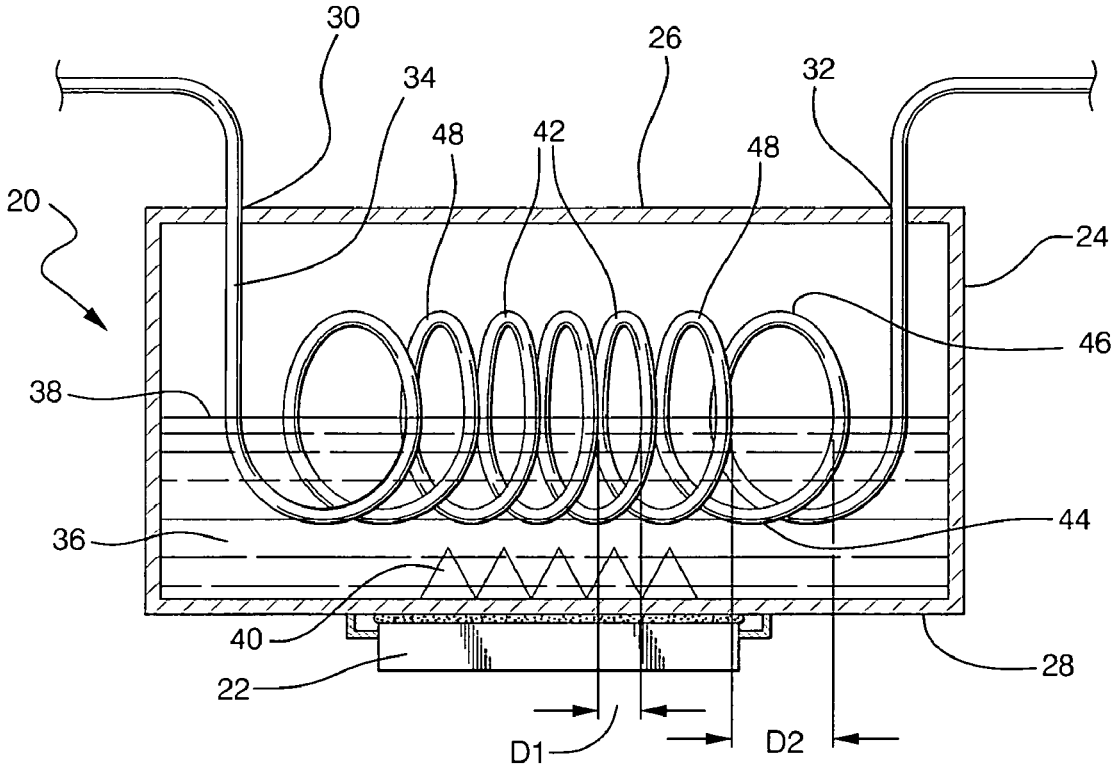
FIG. 3 is a cross sectional view of the heat exchanger shown in FIG. 1 in which the heat exchanger of the subject invention has varying coil densities.

The assembly 20 is distinguished by the tube 34 being coiled in adjacent coils 42 disposed on an axis parallel to the surface 38 of the liquid refrigerant 36. The coils 42 of the tube 34 are circular and uniform. However, the coils 42 could be any number of shapes including an oval and could be set forth in a random or non-uniform pattern along the axis. For increased heat transfer efficiency, the coil density along the axis may be varied. The varying coil density is illustrated in FIG. 3 where the distance Dl between coils 42 in the immediate vicinity above the fins 40 is lesser than the distance D2 between the side coils 48, which are located beyond the ends of the fins 40. The higher coil density above the fins 40 provides enhanced heat transfer from the electronic device 22 to the cooling liciuid disposed in tube 34.

The axis is positioned such that a first sector 44 (one half) of each coil 42 is disposed below the surface 38 of the liquid refrigerant 36 and a second sector 46 (second half) of each coil 42 is disposed above the liquid surface 38 whereby the tube 34 runs into and out of the liquid refrigerant 36. The axis on which the coils 42 are disposed is preferably straight but could extend along a curve or even a zigzag pattern.

The electronic device 22 generates an amount of heat to be dissipated and the heat is transferred from the electronic device 22 to the bottom of the lower portion 28 of the heat exchanger housing 24. The heat is conducted into the fins 40 and thereafter from the fins 40 to the liquid refrigerant 36 housed in the lower portion 28 of the housing 24 thereby causing the liquid refrigerant 36 to boil. The heat is then inducted into the cooling liquid disposed in the tube 34 extending from the inlet 30 to the outlet 32. The heat moves both from the liquid refrigerant 36 and from the vapor boiled off of the liquid refrigerant 36 as the vapor condenses on the tube 34.

The invention also provides a method of cooling the electronic device 22 by transferring heat generated by the electronic device 22 to the lower portion 28 of the housing 24 and transferring the heat to the refrigerant 36 disposed in the lower portion 28 of the housing 24. The method further includes the step of vaporizing liquid into vapor from the surface 38 of the liquid refrigerant 36, and is distinguished by flowing cooling liquid into and out of the liquid refrigerant 36 in adjacent coils 42 in a helical path within the housing 24.

Obviously, many modifications and variations of the present invention are possible in light of the above teachings. The invention may be practiced otherwise than as specifically described within the scope of the appended claims.

What is claimed is:

1. A fluid heat exchanger assembly for cooling an electronic device comprising;

a housing having a lower portion holding a liquid refrigerant for undergoing a liquid-to-vapor-condensate cycle within said housing and presenting a surface for liquid-to-vapor transformation, wherein said lower portion includes an interior middle portion, said housing having an upper portion for condensing vapor boiled off said liquid refrigerant, an inlet and an outlet disposed in said upper portion of said housing, a tube adapted to remove heat from within said housing, wherein said tube being of a uniform cross-section disposed in said housing and extending between said inlet and said outlet for establishing a flow of cooling liquid through said housing from said inlet to said outlet, said housing being hermetically sealed about said tube, and a plurality of heat transfer fins disposed in said interior middle section of said lower portion of said housing for transferring heat from an electronic device disposed on the exterior of said lower portion of said housing to said liquid refrigerant, said tube being coiled in adjacent circular coils disposed on an axis parallel to said surface of said liquid refrigerant with a first sector of each coil disposed below said liquid surface and a second sector of each coil disposed above said liquid surface whereby said tube runs into and out of said liquid refrigerant, wherein said tube includes a middle and opposite ends, wherein said middle is positioned proximal to said heat transfer fins, and wherein the space between adjacent coils is greater at the ends than in the middle.

* * * * *